United States Patent [19]

Higuchi

[11] Patent Number: 4,960,366

[45] Date of Patent: Oct. 2, 1990

[54] SLANT PLATE TYPE COMPRESSOR WITH VARIABLE DISPLACEMENT MECHANISM

[75] Inventor: Teruo Higuchi, Isesaki, Japan

[73] Assignee: Sanden Corporation, Gunma, Japan

[21] Appl. No.: 344,381

[22] Filed: Apr. 28, 1989

[30] Foreign Application Priority Data

Apr. 28, 1988 [JP] Japan ..... 63-58355[U]

[51] Int. Cl.[5] ..... F04B 1/26

[52] U.S. Cl. ..... 417/222; 417/269

[58] Field of Search ..... 417/222 S, 222 R, 269; 91/505

[56] References Cited

U.S. PATENT DOCUMENTS

| | | | |
|---|---|---|---|
| 4,037,993 | 7/1977 | Roberts . | |
| 4,428,718 | 1/1984 | Skinner . | |
| 4,475,871 | 10/1984 | Roberts . | |
| 4,480,964 | 11/1984 | Skinner . | |
| 4,543,043 | 9/1985 | Roberts . | |
| 4,586,874 | 5/1986 | Hiraga et al. . | |
| 4,632,640 | 12/1986 | Terauchi . | |
| 4,664,604 | 5/1987 | Terauchi . | |
| 4,732,544 | 3/1988 | Kurosawa et al. . | |
| 4,880,360 | 11/1989 | Terauchi et al. | 417/222 S |

FOREIGN PATENT DOCUMENTS

| | | |
|---|---|---|
| 0090486 | 2/1983 | European Pat. Off. . |
| 0292288 | 5/1988 | European Pat. Off. . |
| 59-16089 | 8/1985 | Japan . |
| 62-55478 | 3/1987 | Japan . |
| 1436390 | 5/1976 | United Kingdom . |
| 2153922 | 8/1985 | United Kingdom . |

*Primary Examiner*—Gerald A. Michalsky

*Attorney, Agent, or Firm*—Banner, Birch, McKie & Beckett

[57] ABSTRACT

A slant plate type compressor including a housing having a cylinder block is disclosed. A plurality of cylinders are formed around the periphery of the cylinder block and a piston is slidably fitted within each of the cylinders and is reciprocated by a drive mechnism. The drive mechanism includes a drive shaft rotatably supported in the compressor housing and a coupling mechanism for drivingly coupling the shaft to the pistons such that rotary motion of the shaft is converted into reciprocating motion of the pistons. The coupling mechanism includes a plate having a surface disposed at a slant angle relative to the drive shaft. The slant angle changes in response to the change in pressure in the crank chamber to change the capacity of the compressor. A bias spring is mounted on the drive shaft between the slant plate and the cylinder block and urges the slant plate towards the maximum slant angle. The drive shaft includes one portion having a smaller diameter than the remainder of the drive shaft. The inner diameter of the bias spring is smaller than the diameter of the remainder of the shaft at one end of the spring, and the spring is firmly secured to the shaft at the smaller end by a snap ring disposed on the shaft at the location where the smaller diameter portion of the shaft is integrally formed with the remainder of the shaft to sandwich the end of the spring against the drive shaft.

11 Claims, 4 Drawing Sheets

SLANT PLATE TYPE COMPRESSOR WITH VARIABLE DISPLACEMENT MECHANISM

BACKGROUND OF THE INVENTION

1. Field Of The Invention

The present invention generally relates to a refrigerant compressor and, more particularly, to a slant plate type compressor, such as a wobble plate type compressor, with a variable displacement mechanism suitable for use in an automotive air conditioning system.

2. Description Of The Prior Art

A wobble plate compressor with a variable displacement mechanism suitable for use in an automotive air conditioning system is disclosed in U.S. Pat. No. 3,861,829 to Roberts et al. As disclosed therein, the compression ratio of the compressor may be controlled by changing the slant angle of the inclined surface of the wobble plate. The slant angle of the inclined surface of the wobble plate changes in response to a change in the crank chamber pressure. Changes in the crank chamber pressure are generated by a valve control mechanism which controls communication between the suction chamber and the crank chamber.

The relevant part of an additional prior art compressor is shown in FIGS. 1*a* and 1*b*. Drive shaft 1 includes groove 2 located near one end thereof. Split ring return spring 3 is fixed in groove 2 by snap portion 4. When the slant plate reaches its minimum or zero slant angle, it is contacted by split ring return spring 3 which urges it back towards greater slant angles. However, since split ring return spring 3 is not firmly fixed within groove 2, it may fall off during rotation of the drive shaft. Additionally, split ring return spring 3 occupies a large radial space around drive shaft 1, and thus has a tendency to interfere with other internal parts of the compressor.

Additionally, if a bias spring were used in place of the split ring return spring with the grooved drive shaft shown in FIGS. 1*a* and 1*b*, and no provision for firmly securing the bias spring to the drive shaft is made, the bias spring may move along the drive shaft during rotation thereof. Thus, the bias spring may become fixed at an undesirable location on the drive shaft and may therefore prevent the slant plate from pivoting to freely assume various slant angles. Accordingly, the variable displacement function of the compressor may be ineffective.

SUMMARY OF THE INVENTION

It is an object of the present invention to provide a variable capacity slant plate type compressor having a bias spring secured to the drive shaft to urge the slant plate back towards maximum slant angle without interfering with the free pivoting motion of the slant plate between various inclination angles.

A slant plate type compressor in accordance with the present invention includes a compressor housing having a cylinder block with a front end plate and a rear end plate attached thereto. The front end plate encloses a crank chamber within the cylinder block, and a plurality of cylinders are formed in the cylinder block. A piston is slidably fitted within each of the cylinders. A drive mechanism is coupled to the pistons to reciprocate the pistons within the cylinders. The drive mechanism includes a drive shaft rotatably supported in the compressor housing, a rotor coupled to the drive shaft and rotatable therewith, and a coupling mechanism for drivingly coupling the rotor to the pistons such that rotary motion of the rotor is converted into reciprocating motion of the pistons within the cylinders. The coupling mechanism includes a slant plate having a surface disposed at a slant angle relative to a plane perpendicular to the drive shaft. The capacity of the compressor is varied as the slant angle changes.

The rear end plate includes a suction chamber and a discharge chamber defined therein. A communication path through the cylinder block links the crank chamber with the suction chamber. A valve control mechanism controls the opening and closing of the communication path, thereby generating a change in the pressure in the crank chamber. The slant angle of the slant plate changes in response to changes in the crank chamber pressure. A bias spring is securely mounted at one end on the drive shaft and is positioned between the slant plate and the cylinder block and acts to urge the slant plate towards the maximum slant angle. The drive shaft has one portion having a smaller diameter than the remainder of the shaft. The inner diameter of at least one helical loop of the bias spring at the side opposite the slant plate side is smaller than the diameter of the drive shaft at that position. A snap ring firmly secures the bias spring to the drive shaft so that axial movement is prevented.

DETAILED DESCRIPTION OF THE PREFERRED EMBODIMENTS

Although the present invention is described below in terms of a wobble plate type compressor, it is not limited in this respect. The present invention is broadly applicable to slant plate type compressors.

Figure 1A:
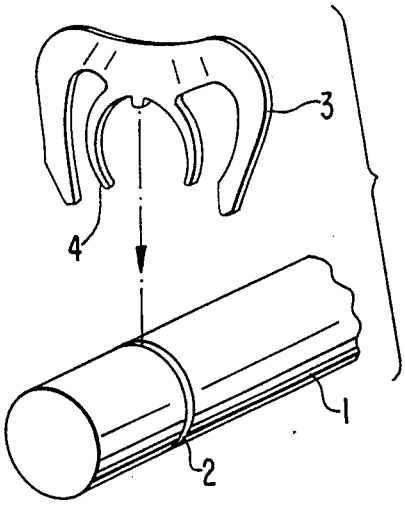
FIG. 1a PRIOR ART
FIGS. 1*a* and 1*b* show a portion of a prior art compressor.
Figure 1B:
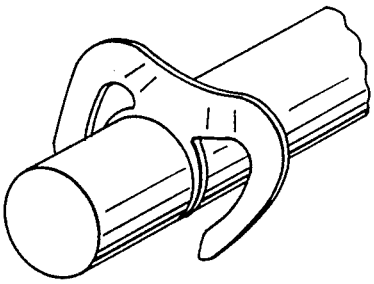
FIG. 1b PRIOR ART
Figure 2:
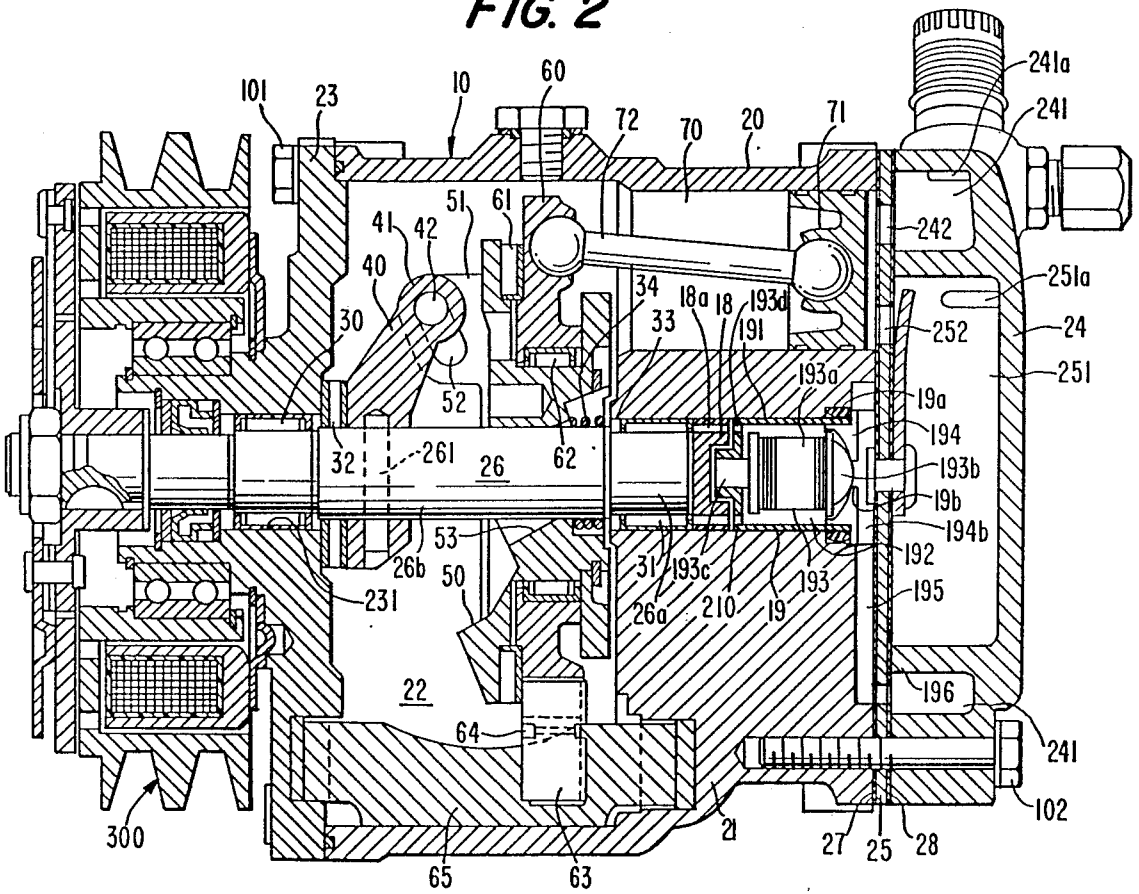
FIG. 2 is a longitudinal sectional view of a wobble plate type refrigerant compressor in accordance with a first embodiment of this invention in which the slant angle of the slant plate is minimum.

A wobble plate type refrigerant compressor in accordance with the present invention is shown in FIG. 2. Compressor 10 includes cylindrical housing assembly 20 including cylinder block 21, front end plate 23 disposed at one end of cylinder block 21, crank chamber 22 enclosed within cylinder block 21 by front end plate 23, and rear end plate 24 attached to the other end of cylinder block 21. Front end plate 23 is secured to one end of cylinder block 21 by a plurality of bolts 101. Rear end plate 24 is secured to the opposite end of cylinder block 21 by a plurality of bolts 102. Valve plate 25 is disposed between rear end plate 24 and cylinder block 21. Opening 231 is formed centrally in front end plate 23 for supporting drive shaft 26 by bearing 30 disposed therein. Drive shaft 26 includes inner end portion 26*a* and intermediate portion 26*b* adjacent to inner end portion 26*a*. The diameter of inner end portion 26*a* is less than the diameter of intermediate portion 26*b*. Inner end portion 26*a* of drive shaft 26 is rotatably supported by bearing 31 disposed within central bore 210 of cylinder block 21. Bore 210 extends to a rear (to the right in FIG. 2) end surface of cylinder block 21 and houses valve control mechanism 19 described in detail below.

Cam rotor 40 is fixed on drive shaft 26 by pin member 261 and rotates therewith. Thrust needle bearing 32 is disposed between the inner end surface of front end plate 23 and the adjacent axial end surface of cam rotor 40. Cam rotor 40 includes arm 41 having pin member 42 extending therefrom. Slant plate 50 is disposed adjacent cam rotor 40 and includes opening 53 through which drive shaft 26 passes. Slant plate 50 is disposed adjacent cam rotor 40 and includes arm 51 having slot 52. Cam rotor 40 and slant plate 50 are coupled by pin member 42 which is inserted in slot 52 to form a hinged joint. Pin member 42 slides within slot 52 to allow adjustment of the slant angle of slant plate 50, that is, the angle of the surface of slant plate 50 with respect to a plane perpendicular to the longitudinal axis of drive shaft 26.

Wobble plate 60 is mounted on slant plate 50 through bearings 61 and 62 such that slant plate 50 may rotate with respect thereto. Fork shaped slider 63 is attached to the outer peripheral end of wobble plate 60 by pin member 64 and is slidably mounted on sliding rail 65 disposed between front end plate 23 and cylinder block 21. Fork shaped slider 63 prevents rotation of wobble plate 60. Wobble plate 60 nutates along rail 65 when cam rotor 40 and slant plate 50 rotate. Cylinder block 21 includes a plurality of peripherally located cylinder chambers 70 in which pistons 71 reciprocate. Each piston 71 is coupled to wobble plate 60 by a corresponding connecting rod 72.

Rear end plate 24 includes peripherally positioned annular suction chamber 241 and centrally positioned discharge chamber 251. Valve plate 25 is located between cylinder block 21 and rear end plate 24 and includes a plurality of valved suction ports 242 linking suction chamber 241 with respective cylinders 70. Valve plate 25 also includes a plurality of valved discharge ports 252 linking discharge chamber 251 with respective cylinders 70. Suction ports 242 and discharge ports 252 are provided with suitable reed valves as described in U.S. Pat. No. 4,011,029 to Shimizu.

Suction chamber 241 includes inlet portion 241*a* which is connected to an evaporator of an external cooling circuit (not shown). Discharge chamber 251 is provided with outlet portion 251*a* connected to a condenser of the cooling circuit (not shown). Gaskets 27 and 28 are positioned between cylinder block 21 and the inner surface of valve plate 25 and the outer surface of valve plate 25 and rear end plate 24 respectively. Gaskets 27 and 28 seal the matting surface of cylinder block 21, valve plate 25 and rear end plate 24.

Valve control mechanism 19 includes cup-shaped casing member 191 disposed within central bore 210 behind the terminal end of drive shaft 26. Cup-shaped casing member 191 defines valve chamber 192 therein. O-ring 19*a* is disposed at an outer surface of casing member 191 to seal the mating surface of casing member 191 and cylinder block 21. Circular plate 194 having central hole 19*b* is fixed to an open end (to the right in FIG. 2) of cup-shaped casing member 191 such that axial gap 194*b* is maintained between valve plate 25 and the rear surface of plate 194. Plate 194 encloses valve chamber 192 within member 191.

Screw member 18 for adjusting the axial position of drive shaft 26 is disposed between inner end portion 26*a* of drive shaft 26 and a closed end (to the left in FIG. 2) of cup-shaped casing 191. Screw member 18 includes a plurality of longitudinal holes 18*a* formed at an outer peripheral portion thereof. A plurality of holes 193*d* are formed at an outer peripheral portion of the closed end of casing member 191 adjacent holes 18*a*.

Valve control mechanism 19 further includes valve member 193 having bellows 193*a*, valve element 193*b* centrally attached to a top end (to the right in FIG. 2) of bellows 193 and adjacent to hole 19*b*, and male screw element 193*c* attached to a bottom end (to the left in FIG. 2) of bellows 193*a*. Bellows 193*a* is charged with gas to maintain a predetermined pressure. Male screw element 193*c* is screwed into the closed end of casing member 191 to firmly secure the bottom end of bellows 193*a*.

Refrigerant gas in crank chamber 22 flows into valve chamber 192 via gaps between bearing 31 and both the outer peripheral surface of inner end portion 26*a* of drive shaft 26 and the inner wall of bore 210, holes 18*a* and holes 193*d*. Therefore, bellows 193*a* contracts or expands longitudinally in response to the pressure in crank chamber 22 so as to position valve element 193*b* to close or open hole 19*b*. Additionally, conduit 195 is radially formed in a rear end (to the right in FIG. 2) of cylinder block 21, adjacent valve plate 25. Conduit 195 extends between gap 194*b* and hole 196 through valve plate 25. Hole 196 links conduit 195 to suction chamber 241.

Figure 3:
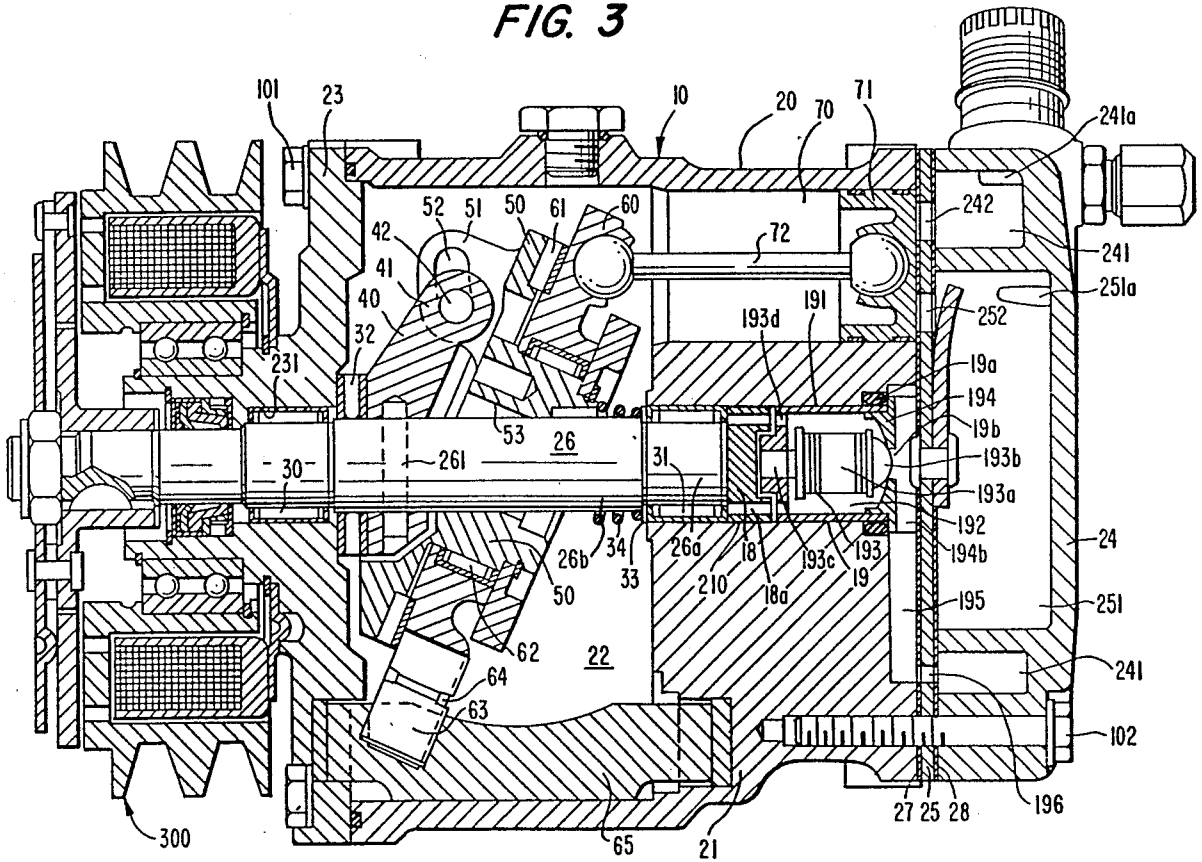
FIG. 3 shows the compressor of FIG. 2 when the slant angle is maximum.

Snap ring 33 is attached to inner end portion 26*a* of drive shaft 26, and is adjacent to intermediate portion 26*b* of drive shaft 26. Bias spring 34 is mounted on intermediate portion 26*b* of drive shaft 26, at a position between slant plate 50 and snap ring 33. One end of bias spring 34 is firmly secured to drive shaft 26 by snap ring 33 as will be explained more fully below. The non-tensioned length of bias spring 34 when no force acts thereon is selected such that the other non-secured end of bias spring 34 does not contract any portion of the rear surface of slant plate 50, so long as the slant angle of slant plate 50 is in a range between the maximum slant angle as shown in FIG. 3, and a selected intermediate slant angle. For example, the intermediate angle could be selected to be thirty percent of the maximum slant angle. Accordingly, slant plate 50 is urged towards the maximum slant angle by the restoring force of bias spring 34 if the slant angle of slant plate 50 decreases to below thirty percent of the maximum slant angle. When the slant angle of slant plate 50 is maximum, the compressor operates with maximum displacement.

Figure 4:
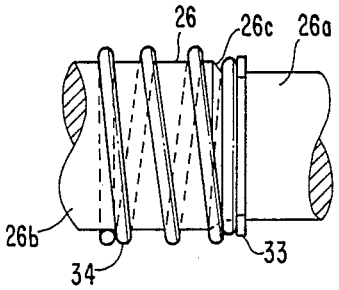
FIG. 4 is an enlarged perspective view of a portion of the drive shaft shown in FIG. 2 according to a first embodiment of the invention.

With reference to FIG. 4, a first embodiment of the invention will be described in detail. Inner end portion 26*a* of drive shaft 26 has a smaller diameter than the diameter of intermediate portion 26*b* of drive shaft 26. Tapered ridge portion 26*c* is formed between portion 26*a* and intermediate portion 26*b* of integrally formed drive shaft 26. Bias spring 34 is disposed around drive shaft 26. One end (to the right in FIG. 4) of bias spring 34 is disposed about inner end portion 26*a*, adjacent to tapered ridge portion 26*c*. The other end (to the left in FIG. 4) of bias spring 34 extends towards slant plate 50 as discussed above. The inner diameter of the right end of bias spring 34 is smaller than the diameter of intermediate portion 26*b*. Snap ring 33 is attached to inner end portion 26*a*. The right end of bias spring 34 is contained or sandwiched between tapered ridge portion 26*c* and snap ring 33. Accordingly, axial movement of bias spring 34 along drive shaft 26 is prevented. Additionally, snap ring 33 resists the reaction force generated by spring 34 due to the compression of the spring by slant plate 50 when it assumes minimal slant angles and the subsequent restoring force generated by spring 34 to urge the slant plate back to the maximum slant angle.

Figure 5:
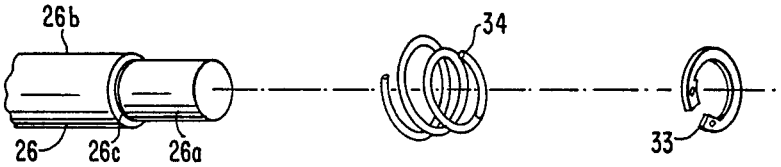
FIG. 5 is an expanded perspective view of the portion in FIG. 4.

With reference to FIG. 5, the assembling process of the first embodiment is described. Portion 26*a* is held adjacent to the left end of bias spring 34, and drive shaft 26 is inserted through bias spring 34 until the right end of bias spring 34 contacts tapered ridge portion 26*c* of drive shaft 26. Snap ring 33 is mounted on drive shaft 26 from the inner end portion side. Snap ring 33 contacts the right end of bias spring 34 and is firmly fixed on inner end portion 26*a* of drive shaft 26 to sandwich the right end of bias spring 34 against tapered ridge portion 26*c*.

During operation of compressor 10, drive shaft 26 is rotated by the engine of the vehicle (not shown) through electromagnetic clutch 300. Cam rotor 40 rotates with drive shaft 26, causing slant plate 50 to rotate as well. The rotation of slant plate 50 causes wobble plate 60 to nutate. The nutating motion of wobble plate 60 reciprocates pistons 71 in their respective cylinders 70. As pistons 71 are reciprocated, refrigerant gas introduced into suction chamber 241 through inlet portion 241*a* is drawn into cylinders 70 through suction ports 242 and subsequently compressed. The compressed refrigerant gas is discharged from cylinders 70 to discharge chamber 251 through respective discharge ports 252 and then into the cooling circuit through outlet portion 251*a*.

During operation of compressor 10 some of the partially compressed refrigerant gas in cylinders 70 is blown into crank chamber 22 from cylinders 70 through gaps between respective pistons 71 and cylinders 70. (This gas is known as blow-by gas.) The partially compressed refrigerant gas in crank chamber 22 then flows into valve chamber 192 via the gaps between bearing 31 and both the outer peripheral surface of inner end portion 26*a* of drive shaft 26 and the inner wall of bore 210, and holes 18*a* and holes 193*d*. When the pressure in crank chamber 22, which is essentially the same as the pressure in valve chamber 192, exceeds the predetermined pressure in bellows 193*a*, bellows 193*a* contracts, opening hole 19*b*. Thereafter, crank chamber 22 is linked to suction chamber 241. Accordingly, the pressure in crank chamber 22 decreases to the pressure in suction chamber 241. However, if pressure in crank chamber 22 decreases to below the predetermined pressure in bellows 193*a*, bellows 193*a* expands, and valve element 193*b* closes hole 19*b*. Therefore, communication between crank chamber 22 and suction chamber 241 is prevented. Thus, the pressure level in crank chamber 22 is controlled by valve control mechanism 19.

In operation, the pressure in crank chamber 22 gradually increases due to the partially compressed (blow-by) refrigerant gas from cylinders 70. A change in the pressure in crank chamber 22 generates a corresponding change in the slant angle of both slant plate 50 and wobble plate 60 so as to change the stroke length of pistons 71 in cylinders 70, to vary the displacement of compressor 10. Furthermore, if the slant angle of slant plate 50 decreases to below a predetermined value, for example, below thirty percent of the maximum slant angle, slant plate 50 is urged back towards the maximum slant angle by the restoring force of bias spring 34.

Figure 6:
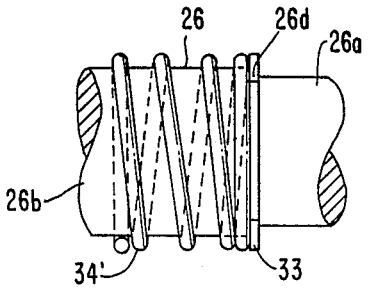
FIG. 6 is an enlarged perspective view of a second embodiment of the invention.

With reference to FIG. 6, a second embodiment of this invention is shown. In the second embodiment, the inner diameter of the right end of bias spring 34' is smaller than the diameter of intermediate portion 26*b* of drive shaft 26. However, spring 34' is forcibly mounted about drive shaft 26 from the inner end side such that the right end of spring 34' is adjacent to ridge 26*d*. Snap ring 33 is firmly fitted on inner end portion 26*a* of drive shaft 26 to contact the right end of bias spring 34' to prevent axial movement thereof.

Figure 7:
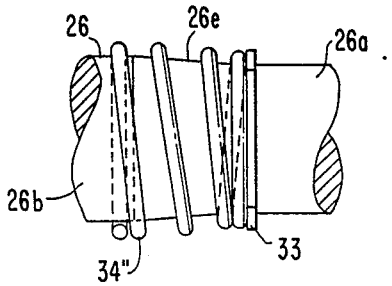
FIG. 7 is an enlarged perspective view of a third embodiment of the invention.

With reference to FIG. 7, a third embodiment of this invention is shown. In this embodiment, intermediate portion 26*b* of drive shaft 26 includes tapered portion 26*e*. Inner end portion 26*a* is integral with the right end of tapered portion 26*e* (to the right in FIG. 6) so as to have the same diameter at the right end of tapered portion 26*e*. The inner diameter of the right end of bias spring 34" is smaller than the diameter of the end of tapered portion 26*e*. Bias spring 34" is forcibly mounted about drive shaft 26 from the inner end side of drive shaft 26 so that the right end of spring 34" is adjacent to the right end of tapered portion 26*e*. Snap ring 33 is firmly fitted on inner end portion 26*a* of drive shaft 26 to contact the right end of bias spring 34" to prevent axial movement thereof.

This invention has been described in connection with the preferred embodiments. These embodiments, however, are merely for example only and the invention is not restricted thereto. For example, the terms right and left are used merely for convenience of description, and the invention is not restricted in this manner. It will be understood by those skilled in the art that other variations and modifications of this invention can easily be made within the scope of this invention as defined by the claims.

I claim:

1. A method of constructing a slant plate type compressor including a drive shaft, a slant plate disposed on said drive shaft and variable between a maximum and a minimum slant angle relative to a plane perpendicular to said drive shaft, and a bias spring disposed on said drive shaft to restore said slant plate back to a maximum angle when the slant angle is decreased to below a predetermined angle, said a method of constructing said compressor comprising:

constructing said drive shaft to have an inner portion having a smaller diameter than a remainder of said drive shaft, said inner portion and said remainder integrally formed;

constructing said bias spring to have one end having an inner diameter smaller than the diameter of said remainder of said drive shaft;

disposing said bias spring on said drive shaft by inserting said inner portion of said drive shaft into an end of said bias spring opposite said one end until said one end is adjacent a location of said drive shaft where said inner portion and said remainder are integrally formed;

and securely fixing said one end of said bias spring to said drive shaft at said location.

2. The method recited in claim 1 said step of securely fixing said spring to said drive shaft comprising disposing a snap ring about said inner portion of said drive shaft, and moving said snap ring along said inner portion until said snap ring sandwiches said one end of said bias spring against said drive shaft at said location where said inner portion and the remainder of said drive shaft are integrally formed.

3. In a slant plate type compressor, said compressor including a compressor housing having a cylinder block provided with a plurality of cylinders, a front end plate disposed on one end of said cylinder block and enclosing a crank chamber within said cylinder block, a piston slidably fitted within each of said cylinders, a drive shaft rotatably supported in said housing, and coupling means for drivingly coupling said pistons with said drive shaft such that rotary motion of said drive shaft is converted into reciprocating motion of said pistons within said cylinders, said coupling means including a slant plate disposed on said drive shaft and undergoing rotational motion with said drive shaft, said slant plate having a surface disposed at a slant angle relative to a plane perpendicular to said drive shaft, said slant angle adjustable between a maximum and a minimum angle and changing in response to a change in pressure in said crank chamber to change the capacity of said compressor, a rear end plate disposed on the opposite end of said cylinder block from said front end plate and defining a suction chamber and a discharge chamber therein, a communication path linking said crank chamber with said suction chamber, a valve control means for controlling the opening and closing of said communication path to control the pressure in said crank chamber, a bias spring mounted about said drive shaft at a location between said slant plate and said cylinder block to urge said slant plate towards the maximum slant angle, the improvement comprising:

said drive shaft having an inner portion having a smaller diameter than the remainder of said drive shaft, said inner portion and said remainder integrally formed, said bias spring having one end having an inner diameter smaller than the diameter of said remainder of said drive shaft, said one end of said bias spring being the end disposed further away from said slant plate, said bias spring disposed on said drive shaft such that said one end is opposite said slant plate and said one end is secured to said drive shaft adjacent a location of said drive shaft where said inner portion and said remainder are integrally formed.

4. The compressor recited in claim 3, said bias spring having a predetermined length such that when no tension force acts on said bias spring, said spring does not contact said slant plate when said slant angle is in a range extending between the maximum angle to a predetermined intermediate angle which is greater than said minimum angle.

5. The compressor recited in claim 4, wherein said intermediate angle is approximately thirty percent of said maximum angle.

6. The compressor recited in claim 3, said location where said inner portion and said remainder are integrally formed comprising a ridge, said compressor further comprising a snap ring fixed about said inner portion and sandwiching said one end of said bias spring against said ridge, said snap ring resisting the reaction force of the spring when said spring urges said slant plate back towards the maximum slant angle after the slant angle has decreased to below a predetermined angle.

7. The compressor recited in claim 6, wherein said ridge is tapered.

8. The compressor recited in claim 3, said drive shaft including an extending tapered portion integrating said inner portion and said remainder, said compressor further comprising a snap ring disposed about said inner portion and sandwiching said one end of said bias spring against said tapered portion.

9. The compressor recited in claim 3, said coupling means further including a wobble plate disposed about said slant plate such that said slant plate is rotatable with respect to said wobble plate, rotational motion of said slant plate converted into nutational motion of said wobble plate, said compressor further including a plurality of connecting rods, each connecting rod linking one said piston to said wobble plate, nutational motion of said wobble plate causing reciprocating motion of said pistons within said cylinders.

10. The compressor recited in claim 3, said coupling means further including a cam rotor disposed about said drive shaft, said drive shaft and said cam rotor coupled for joint rotation, said slant plate hingedly connected to said cam rotor, said hinge connection allowing the slant angle of said slant plate to be varied, rotational motion of said drive shaft causing rotational motion of said slant plate via said cam rotor.

11. In a slant plate type compressor including a drive shaft disposed therein, a slant plate disposed on said drive shaft and having a surface variably disposed between a maximum and a minimum slant angle relative to a plane perpendicular to said drive shaft, and a bias spring disposed on said drive shaft and acting to restore said slant plate back to said maximum slant angle when the slant angle is decreased to an angle which is below a predetermined angle between said maximum and said minimum slant angles, the improvement comprising:

said drive shaft having an inner portion having a smaller diameter than the remainder of said drive shaft, said inner portion and said remainder integrally formed, said bias spring having one end having an inner diameter smaller than the diameter of said remainder of said drive shaft, said one end of said bias spring being the end disposed further away from said slant plate, said bias spring disposed on said drive shaft such that said one end is opposite said slant plate and said one end is secured to said drive shaft adjacent a location of said drive shaft where said inner portion and said remainder are integrally formed.

* * * * *